US005646359A

United States Patent [19]

Kihara et al.

[11] Patent Number: 5,646,359

[45] Date of Patent: Jul. 8, 1997

[54] SILENCING METHOD AND APPARATUS FOR PIANOS

[75] Inventors: Tsutomu Kihara, Hamamatsu; Kiyoshi Abe, Fukuroi, both of Japan

[73] Assignee: Kabushiki Kaisha Kawai Gakki Seisakusho, Shizuoka-Ken, Japan

[21] Appl. No.: 453,749

[22] Filed: May 30, 1995

[30] Foreign Application Priority Data

May 31, 1994 [JP] Japan ..... 6-118260

[51] Int. Cl.[6] ..... G10C 3/00

[52] U.S. Cl. ..... 84/216; 84/220; 84/171

[58] Field of Search ..... 84/216, 220, 171

[56] References Cited

U.S. PATENT DOCUMENTS 511,747 1/1894 Bettendorf ..... 84/220
686,251 11/1901 Busenbury ..... 84/220
3,640,171 2/1972 Giglio ..... 84/220
5,374,775 12/1994 Kawamura ..... 84/171

*Primary Examiner*—Cassandra C. Spyrou
*Attorney, Agent, or Firm*—Davis and Bujold

[57] ABSTRACT

A silencing apparatus is provided for pianos having an electronic sound source as well as the conventional acoustic sound mechanism. The silencing apparatus includes a plurality of arms, a stop rail bridging ends of the arms and a positioning mechanism. When acoustic sound is to be silenced, a wire is pulled by means of an operating lever, thereby pivoting an actuating lever which is connected to one of the arms. This causes the stop rail to pivot to the stop position at which the stop rail abuts against and thereby stops motion of the hammer shanks which move in response to key depressions. The stop rail and the arms thereon define open spaces for accommodating for the presence of the other components, such as damper units, inside the piano. Thus, the silencing apparatus of the present invention travels over a greater range of motion without interfering with the operation of other components inside the piano.

18 Claims, 6 Drawing Sheets

SILENCING METHOD AND APPARATUS FOR PIANOS

FIELD OF THE INVENTION

This invention relates to a silencing apparatus and method for pianos that prevents the hammers from striking the strings by stopping the motion of the hammer shanks which are moved in response to the depression of corresponding keys.

BACKGROUND OF THE INVENTION

Pianos are known that have an electronic sound source as well as the usual acoustic sound mechanism, and can be switched between an acoustic sound mode in which only acoustic sound is generated by hammer's striking the strings and an electronic sound mode in which only electronic sound is generated. In such pianos, the hammers are prohibited from striking the strings when the piano is in the electronic sound mode. The prohibition is performed by a stop rail which abuts and thereby stops the hammer shanks which move in response to the depression of corresponding keys of the piano.

Stop rail 90 shown in FIG. 5A is an example of the prior art. The stop rail 90 is rotatable between the stop position, indicated by solid lines, to stop the movement of the hammer shanks 100, only one of which is shown, and the retracted position, indicated by broken lines, to permit the hammer shanks 100 to continue moving until the not-shown hammers strike the not shown strings.

Stop rail 91 shown in FIG. 5B is another example of the prior art. The stop rail 91 is movable in pure translational movement in a direction perpendicular to the longitudinal axes of the hammer shanks 100, only one of which is shown, between the stop position (solid lines) and the retracted position (broken lines).

In order to effectively stop the hammer shanks 100, the stop rails must be located in the limited available space between the strings, the hammer shanks and the damping mechanism. Since the space where the silencing unit is installed is very narrow, it is not an easy task to install the stop rail. Moreover, if the stop rail is to travel in the manner shown in FIG. 5A, the stop rail may interfere with other components inside the piano. In view of the functions of the stop rail at the stop position and at the retracted position, the range of travel of the stop rail between the stop position to the retracted position is preferably made over the greatest possible distance. With the prior art stop rails, however, this leads to a greater width L of the stop rail, which requires a larger available space and increases the difficulty in installation. The arrangement shown in FIG. 5B also suffers from deficiencies in its relatively complicated travel mechanism and its uneasy adjustment, since pure translational movement is required to be more accurate than the rotational movement shown in FIG. 5A.

For example, if a stop rail of a greater size is adopted, it may intrude upon the pivoting range of the dampers or damper wires disposed along the strings, thereby spoiling the function of the damper unit. If the stop rail is arranged based only upon avoiding the affect on the damper unit, it may fail to effectively stop the hammer shanks before they strike the strings, or may touch the hammer shanks even when the acoustic sound is not to be silenced.

SUMMARY OF THE INVENTION

Wherefore, an object of the present invention is to provide a silencing apparatus for pianos that is easy to install and position when installed in the piano. Moreover, the silencing apparatus according to the invention can travel over a greater distance, by including a novel rotational mechanism, without interfering with other components inside the piano.

In order to attain the stated object, the present invention provides a silencing apparatus including:

a stop rail, when in a stop position, for contacting hammer shanks of the piano and halting motion of the shanks, in response to depression of corresponding keys of the piano, before hammers on the shanks strike strings of the piano;

a plurality of arm members being spaced axially along the stop rail and extending substantially perpendicularly therefrom, ends of the arm members, remote from the stop rail, being pivotally secured to an internal structural member of the piano along a common axis of rotation such that the arm members and the stop rail are pivotable about the axis of rotation from the stop position to a retracted position, remote from the stop position, for permitting the hammers to strike the strings;

wherein each adjacent pair of arm members define a space therebetween, the space being open on a side thereof remote from the stop rail, and, when the stop rail is located in the retracted position, a range of motion of at least one of a damper mechanism of the piano and the hammer shanks extends into the open spaces between adjacent pairs of arm members such that motion of the at least one of the damper mechanism and the hammer shanks is unhindered.

In the above arrangement, the sound silencing condition is obtained by operating a positioning mechanism that causes the arm members to selectively pivot the stop rail to the stop position and the retracted position. The operation of the damper units and the like are not interfered with by the stop rail by virtue of open spaces between adjacent arm members. The same advantage can be obtained when longer arm members are adopted for pivoting the stop rail over a greater range of motion. Therefore, in spite of its greater range of motion, using the simple, rotational mechanism, the silencing apparatus does not interfere with the other components in the piano, and its installation and positioning when installed are facilitated.

Even if the space between the arm members is within the pivoting range of the dampers or damper wires, the stop rail does not interfere with the operation of the dampers or damper wires. The same effect is also obtained with respect to the hammers when the space between the arm members is within a pivoting range of the hammers or hammer shanks.

The stop rail may be formed in a variety of configurations. For instance, the corner of the stop rail or the surface of the stop rail that abuts against the hammer shanks may be rounded. The stop rail may be circular or elliptical in cross section. The circular or elliptical cross section of the stop rail may be provided only at the side where the stop rail abuts against the hammer shanks. Alternatively, only the cushion member that is provided on the abutting surface of the stop rail may be circular or elliptical in cross section.

By having the above described configuration, the stop rail is prevented from hitting the hammer shanks with a corner having a sharp angle, even when the stop position at which the stop rail abuts against the hammer shanks is slightly altered. This feature is particularly advantages for the cushion member after repeated impacts of the hammer shanks on the sharp angled corner of the stop rail, which tends to permanently deform the corner and make the stop position deviate forward the retracted position. The present invention makes it possible to readily perform minute adjustment of the stop position without spoiling the stop rails functions at the stop position and the retracted position.

DETAILED DESCRIPTION OF THE PREFERRED EMBODIMENT

Preferred embodiments of the present invention will be described hereinafter wherein similar numerals denote similar elements. There are a plurality of strings with corresponding hammers and damping mechanism. In the following description only one string and its corresponding hammer and damper are described and illustrated for simplicity.

Embodiment 1

An upright piano in the instant embodiment is a combination piano having a not-shown electronic sound source, so as to generate electronic sound in response to operation of the keyboard. When desired, the electronic sound can be heard only through headphones, without any sound being heard in the external environment.

Figure 1:
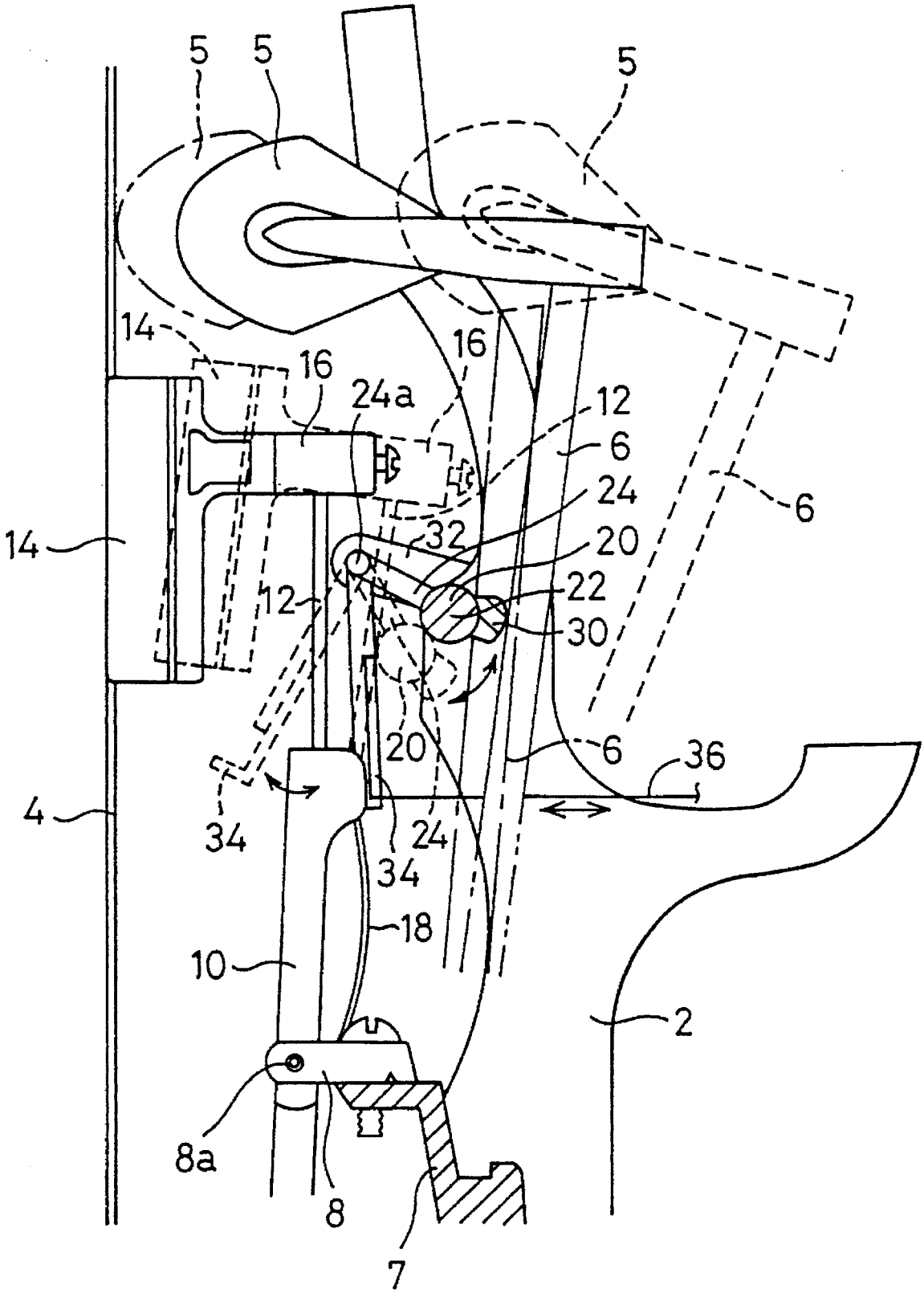
FIG. 1 is a schematic view, partially in cross section, of the silencing apparatus according to a first embodiment of the invention and its peripheral components in an upright piano.

As shown in FIG. 1, a damper unit of the upright piano includes a center rail 7, damper lever 10, damper lever wire 12, damper head 16 and damper lever spring 18. The center rail 7 is horizontally fixed to an action bracket 2, and supports a string striking mechanism, including a hammer 5 and hammer shank 6, to strike a string in response to the depression of a corresponding key by a piano player. The damper lever 10 is fixed to an axle 8*a* so as to be pivotable toward the string 4. An upper end of the damper lever 10 has the damper lever wire 12 extending therefrom, which is made of relatively soft steel wire. The damper head 16 is mounted to an end of the damper lever wire 12, and has a felt 14 which abuts against the string 4. One end of the damper lever spring 18 is fixed to an upper portion of the damper lever 10 and the other end is fixed to a support member 8. The damper lever spring 18 urges the damper lever 10 toward the string 4, such that the felt 14 of the damper head 16 abuts against the string 4.

When the corresponding key is not depressed, the damper lever spring 18 acts upon the damper lever 10 to pivot the upper portion of the damper lever 10 toward the string 4. In this manner, the felt 14 of the damper head 16 is maintained abutting against the string 4, as shown in solid lines in FIG. 1. Vibration of the string 4 is thus dampened.

When the corresponding key is depressed, the damper lever 10 overcomes the stress from the damper lever spring 18 and pivots clockwisely, as shown in broken lines in FIG. 1. The felt 14 is thus retracted away from the spring 4 to permit full sounding of the string 4 when struck by the hammer 5.

When the corresponding key is released, the urging stress of the damper lever spring 18 again becomes the dominant force and causes the damper lever 10 to return to its initial position. The felt 14 on the damper head 16 abuts against the spring 4 and dampens its vibration.

Stop rail 20, as shown in FIG. 1, is provided to abut against the hammer shank 6 when sound is to be silenced and thereby stop the hammer shank 6 before the hammer 5 impacts upon the string 4.

Figure 2:
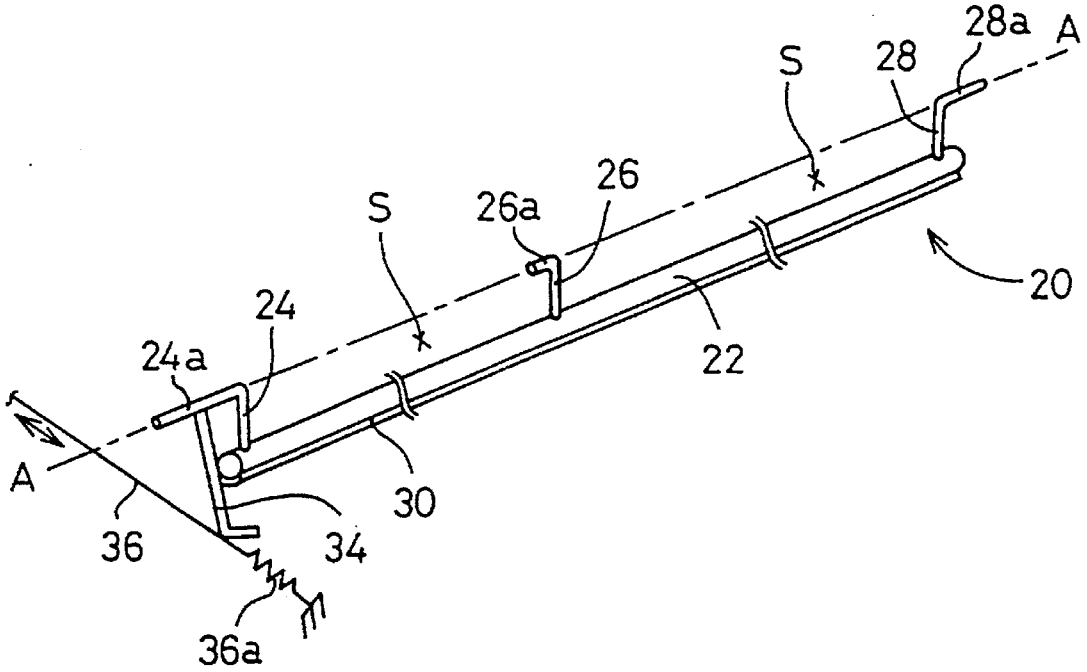
FIG. 2 is a perspective view of the stop rail of FIG. 1 from the opposite end thereof.

Turning to FIG. 2, the stop rail 20 is comprised of a rail part 22, which is a bar-like member having a circular cross section, and three arms 24, 26, and 28. The rail part 22 has a stopper cushion (cushion member) 30 extending longitudinally, substantially entirely along one side thereof. The shape of the stopper cushion 30 conforms to the peripheral surface of the rail part 22 and has a curved outer surface that abuts against the hammer shank 6.

The arms 24, 26 and 28 are substantially L-shaped, and have axial parts 24*a*, 26*a* and 28*a*, respectively, that extend parallel to the longitudinal axis of the rail part 22. Each axial part 24*a*, 26*a* and 28*a* is received into and rotatably supported by a through hole in a supporting member 32 which is mounted to the action bracket 2 of the piano. See FIG. 1.

The axial part 24*a* of the arm 24, located at one end of the stop rail 20, has an actuating lever 34 attached thereto, which is in turn connected to an operating lever, not shown, via a wire 36. A spring 36*a* applies an urging force to the actuating lever 34 that acts in opposition to the tension force of the wire 36. The lever 34, wire 36, spring 36*a* and the operating lever form a positioning mechanism. The afore mentioned operating lever may be replaced by a known foot pedal for effecting selective positioning of the stop rail 22 into the stop and retracted positions.

When the acoustic sound is to be silenced, the wire 36 is pulled, as shown by the solid line in FIG. 1, by operating the operating lever. When the actuating lever 34 is pivoted counterclockwise by pulling on the wire 36, the rail part 22 is pivoted to the stop position, in which the rail part 22 contacts the hammer shank 6, halting its motion. Therefore, the hammer 5 is prevented from striking the string 4, even when the corresponding key is depressed. Thus, the silencing apparatus operates to silence the acoustic sound in the electronic sound mode, in which the sound is only output from the electronic sound source.

The action bracket and the supporting member that support the arm 26 located at the center of the stop rail 20 have a different configuration than that of the action bracket 2 and the supporting member 32, shown in FIG. 1, that support the stop rail 20 at the both ends thereof, such that they do not obstruct operation of the rail part 22. The stop rail 20 may be divided in half at the central action bracket, in which case, the configuration of the central action bracket and its supporting member may be identical to that of the action brackets 2 and the supporting members 32 located at both ends of the rail parts 22.

When the wire 36 is released, the members take the respective positions indicated by broken lines in FIG. 1. Specifically, the lever 34 is pivoted clockwisely and the rail part 22 retracts to the retracted position in which the hammer 5 is free to strike the string 4, as shown in broken lines in FIG. 1. In this manner, the piano is shifted from the electronic sound mode to the acoustic sound mode.

A damper lever spring 18 urges the upper portion of the damper lever 10 toward the string 4, as shown by solid lines in FIG. 1, when the corresponding key is not depressed. When the corresponding key is depressed, the damper lever 10 overcomes the stress from the damper lever spring 18 and pivots clockwisely to the position indicated by broken lines. As a result, the damper lever wire 12 moves across the rotational axis A of the stop rail 20, indicated by a broken line in FIG. 2, and enters into the space S between the arms 24 and 26 or 26 and 28. However, since the rotation of the stop rail 20 is limited within the range between the sound silencing position (the stop position) indicated by solid lines and the acoustic sound position (the retracted position) indicated by broken lines, the motion of the damper lever wire 12, that has entered into the space S, is not interfered with by the stop rail 20. Therefore, the stop rail, while endowed with a greater range of travel by incorporating a rotational mechanism, does not interfere with other components inside the piano. Installation and positioning of the stop rail 20 is also facilitated.

Since the prior art stop rails have no such space S which allows for the presence of the other components, the operation of the damper unit or of the stop rail in the prior art pianos is hindered.

Embodiment 2

Figure 3:
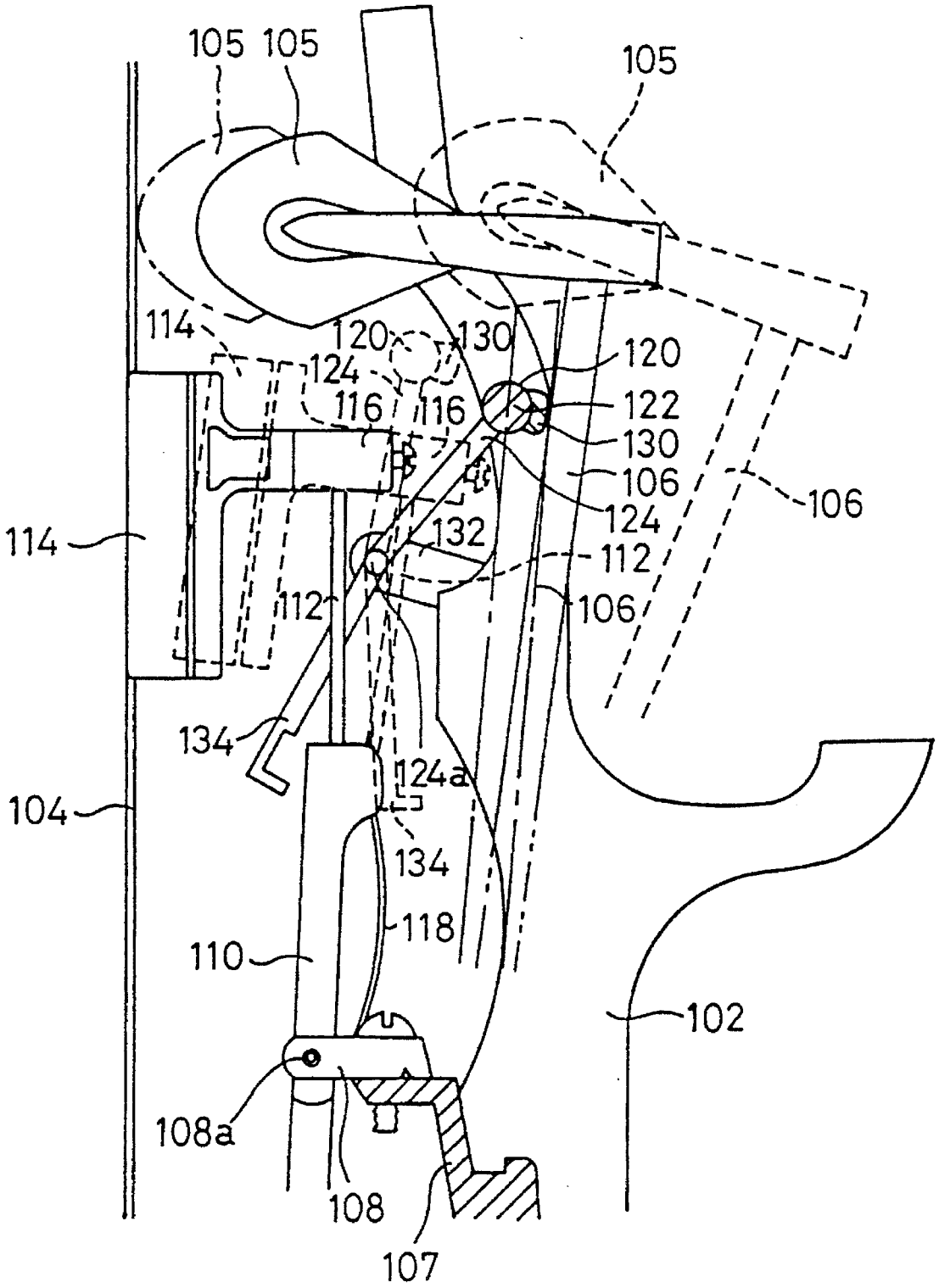
FIG. 3 is a schematic view, partially in cross section, of the silencing apparatus, according to a second embodiment of the invention and its peripheral components.

In the second embodiment shown in FIG. 3, the stop rail 120 is pivotally mounted above the supporting member 132. In this way, the rail part 122 is provided with a greater range of travel between the hammer 105 and the damper head 116. The length of the arm 124, the position of the stop cushion 130 on the rail part 122, and the position of the lever 134 on the axial part 124*a* are determined according to the position of each member depicted in FIG. 3.

Embodiment 3

Figure 4:
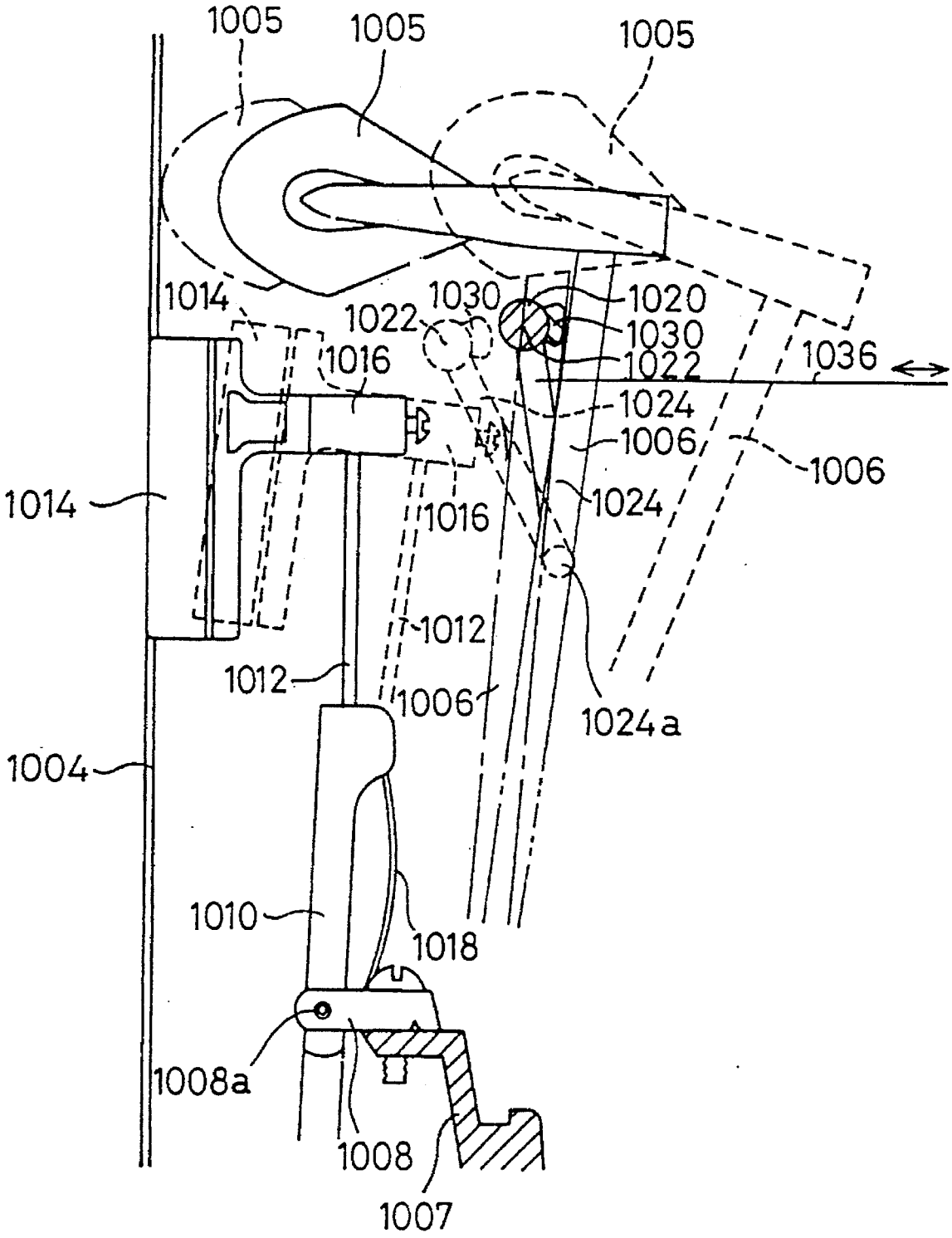
FIG. 4 is a schematic view, partially in cross section, of the silencing apparatus, according to a third embodiment of the invention and its peripheral components.
Figure 5A:
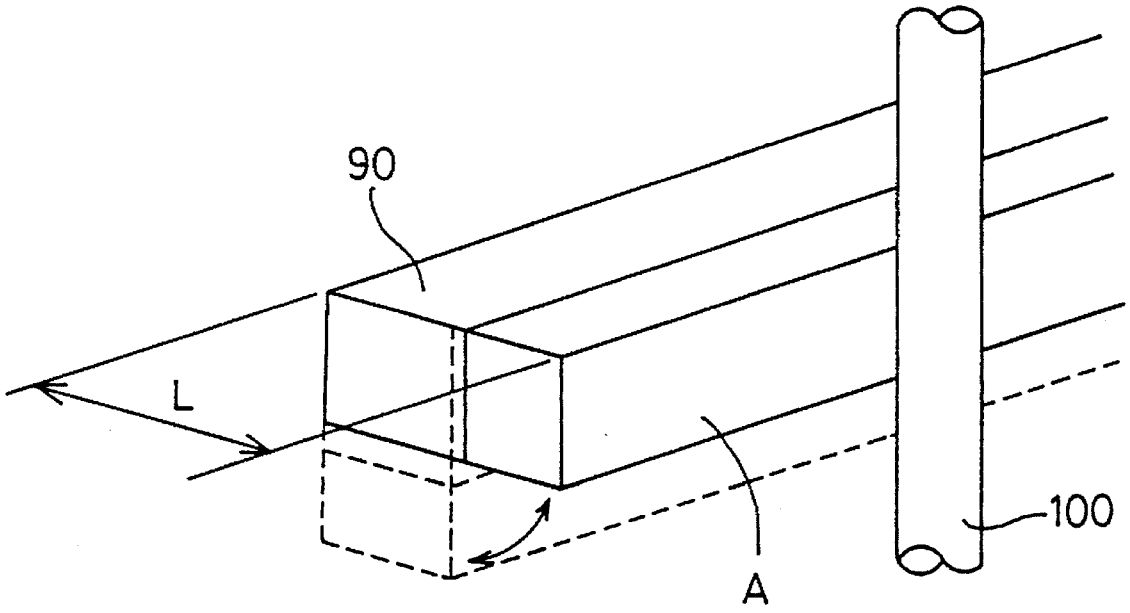
FIG. 5A PRIOR ART
FIGS. 5A and 5B are illustrations of the operation of prior art stop rails.
Figure 5B:
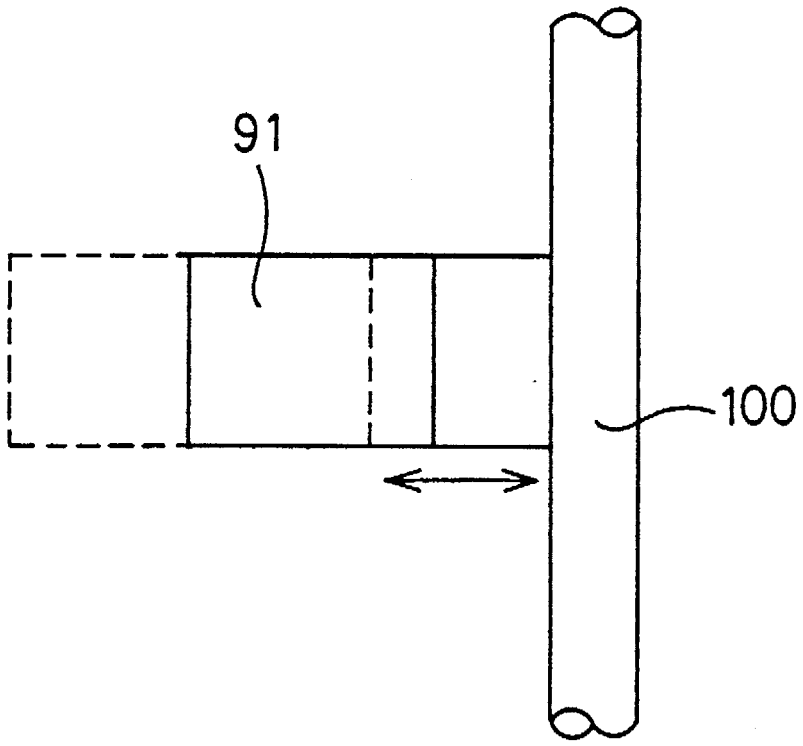
FIG. 5B PRIOR ART

The silencing apparatus of the third embodiment shown in FIG. 4 has axial parts 1024*a* mounted, not to the supporting member 1032, but to a location more closely adjacent to the hammer shank 1006. In this way, the space S between adjacent arm members simultaneously serve as the pivoting space for the hammer shank 1006 and as the pivoting space for the damper head 1016. Moreover, the lever 34 is omitted and the wire 1036 and a not-shown spring 1036*a* are mounted directly to the arm 1024. The stop rail 1020 of the instant embodiment thus has a relatively simple structure. Further, the stop rail 1020 is provided with a greater range of travel. Installation and operation of the stop rail 1020 is facilitated by utilizing a rotational mechanism with such a simple structure.

Since the stop rail according to the present invention can be installed in a desired position and the inner space of the piano can be more efficiently used, the stop rail can be incorporated into an existing piano having a conventional structure and provide a satisfactory silencing effect.

The stop rail of the present invention preferably has a rail part which is circular in cross section. The stopper cushion is provided on the face of the rail part for absorbing shock, and has a rounded outer surface and an inner surface that conforms with the surface of the rail part. Even if the stop position at which the hammer shank is stopped is minutely adjusted, the stopper cushion abuts against the hammer shank in an unchanged manner and not upon a sharp corner of the stopper cushion. The stop position can be thus fixedly defined. In other words, minute adjustments of the stop position can be readily performed without spoiling its function at the stop position and the retracted position. Further, the same effect may also be obtained when the corner of the stopper cushion is rounded.

The present invention has been described above with reference to the preferred embodiments as shown in the drawings. Modifications and alterations may become apparent to one skilled in the art upon reading and understanding the specification. Despite the use of the embodiments for illustration purposes, the invention is intended to include all such modifications and alterations within the scope and spirit of the appended claims. In this spirit, it should also be noted that in the embodiments, the wire 36 is mounted to the lever 34 or the arm 24. However, the wire 36 may be mounted to the other arms 26, 28 and rail part 22. Similarly, the springs 36*a* may be mounted to various other members. Likewise, the rail part 22, 122, 1022 may have any desired cross-section. For example, the rail part may be a flat, rectangular bar. It is only important that the outer contact surface of the stopper cushion 30, 130, 1030 is rounded.

Wherefore, having described the present invention, what is claimed is:

1. A method for selectively damping string striking sounds in a piano comprising the steps of:

providing a stop rail for, when in a stop position, contacting hammer shanks of said piano and halting motion of said shanks, in response to depression of corresponding keys of said piano, before hammers of said shanks strike strings of said piano;

providing a plurality of arm members spaced axially along said stop rail and extending perpendicularly therefrom;

pivotally securing ends of said arm members, remote from said stop rail, to an internal structural member of said piano along a common axis of rotation such that said arm members and said stop rail are pivotable about said axis of rotation from said stop position to a retracted position, remote from said stop position, for permitting said hammers to strike said strings;

defining a space between each adjacent pair of arm members, said space being open on a side thereof remote from said stop rail, and when said stop rail is located in said retracted position, a range of motion of, at least one of a damper mechanism of said piano and said hammer shanks extends into said open spaces between adjacent pairs of arm members such that motion of said at least one of said damper mechanism and said hammer shanks is unhindered; and selectively positioning said stop rail in said retracted position, during an acoustic sound mode and in said stop position, during an electronic sound mode.

2. A method according to claim 1, further comprising the steps of attaching a contact cushion to one side of said stop rail, facing said hammer shanks, substantially along the length of said stop rail; and providing said contact cushion with a convex rounded corner, remote from said stop rail, to define a contact surface for contacting said hammer shanks.

3. A method according to claim 1, further comprising the steps of attaching a contact cushion to one side of said stop rail, facing said hammer shanks, substantially along the length of said stop rail; and providing said contact cushion with a convex rounded outer surface, remote from said stop rail, to define a contact surface for contacting said hammer shanks.

4. A silencing apparatus for a piano comprising:

a stop rail, when in a stop position, for contacting hammer shanks of said piano and halting motion of said shanks, in response to depression of corresponding keys of said piano, before hammers on said shanks strike strings of said piano;

a plurality of arm members being spaced axially along said stop rail and extending substantially perpendicularly therefrom, ends of said arm members, remote from said stop rail, being pivotally secured to an internal structural member of said piano along a common axis of rotation such that said arm members and said stop rail are pivotable about said axis of rotation from said stop position to a retracted position, remote from said stop position, for permitting said hammers to strike said strings;

wherein each adjacent pair of said arm members define an open space therebetween on a side thereof remote from said stop rail, and, when said stop rail is located in said retracted position, a range of motion of at least one of a damper mechanism of said piano and said hammer shanks extends into one of said open spaces between adjacent pairs of said arm members such that motion of said at least one of said damper mechanism and said hammer shanks is unhindered;

an axial portion, coincident with said rotational axis, which extends from at least one of said arm members;

an actuating lever which extends substantially perpendicularly from said axial portion;

a biasing member applies a biasing force to said actuating lever, at a location spaced from said rotational axis, to bias said stop rail into said retracted position; and an operating wire with a first end thereof connected to said actuating lever at a location spaced from said rotational axis and a second end of said wire is connected to an operating device for pulling said actuating bar, via said wire, and applying a force to said actuating lever in opposition to said biasing force thereby moving said stop rail from said retracted position into said stop position.

5. An apparatus according to claim 4, wherein said biasing member is a spring and said operating device is one of a hand operated lever and a foot pedal.

6. An apparatus according to claim 4, wherein said internal structural member includes action brackets, and said arm members are pivotally secured to said action brackets and extend generally downwardly therefrom, and only a portion of the range of motion of said damper mechanism extends into one of said open spaces.

7. An apparatus according to claim 4, wherein said internal structural member includes action brackets, and said arm members are pivotally secured to said action brackets and extend generally upwardly therefrom and support said stop rail at a location above said damper mechanism, and a portion of the range of motion of both said damper mechanism and said hammer shanks extend into one of said open spaces.

8. An apparatus according to claim 4, further comprising a contact cushion attached to a side of said stop rail, facing said hammer shanks, and extending substantially along the length of said stop rail, and said contact cushion has a contact surface for contacting said hammer shanks.

9. A silencing apparatus for a piano comprising:

a stop rail, when in a stop position, for contacting hammer shanks of said piano and halting motion of said shanks, in response to depression of corresponding keys of said piano, before hammers on said shanks strike strings of said piano;

a plurality of arm members being spaced axially along said stop rail and extending substantially perpendicularly therefrom, ends of said arm members, remote from said stop rail, being pivotally secured to an internal structural member of said piano along a common axis of rotation such that said arm members and said stop rail are pivotable about said axis of rotation from said stop position to a retracted position, remote from said stop position, for permitting said hammers to strike said strings;

wherein each adjacent pair of said arm members define an open space therebetween on a side thereof remote from said stop rail, and, when said stop rail is located in said retracted position, a range of motion of at least one of a damper mechanism of said piano and said hammer shanks extends into one of said open spaces between adjacent pairs of said arm members such that motion of said at least one of said damper mechanism and said hammer shanks is unhindered;

said internal structural member includes action brackets, and said arm members are pivotally secured to said action brackets and extend generally downwardly therefrom and only a portion of the range of motion of said damper mechanism extends into one of said open spaces; and supporting members pivotally secure said arm members to said action brackets, said supporting members extend from said action brackets generally toward said strings, and said arm members are pivotally secured, along said common axis of rotation, to ends of said supporting members closest to said strings.

10. An apparatus according to claim 4, wherein said internal structural member includes action brackets, and said arm members are pivotally secured to said action brackets and extend generally upwardly therefrom and support said stop rail at a location above said damper mechanism, and only a portion of the range of motion of said damper mechanism extends into one of said open spaces.

11. An apparatus according to claim 9, further comprising a contact cushion attached to a side of said stop rail, facing said hammer shanks, and extends substantially along the length of said stop rail, and said contact cushion has a contact surface for contacting said hammer shanks.

12. A silencing apparatus for a piano comprising:

a stop rail, when in a stop position, for contacting hammer shanks of said piano and halting motion of said shanks, in response to depression of corresponding keys of said piano, before hammers on said shanks strike strings of said piano;

a plurality of arm members being spaced axially along said stop rail and extending substantially perpendicularly therefrom, ends of said arm members, remote from said stop rail, being pivotally secured to an internal structural member of said piano along a common axis of rotation such that said arm members and said stop rail are pivotable about said axis of rotation from said stop position to a retracted position, remote from said stop position, for permitting said hammers to strike said strings;

wherein each adjacent pair of said arm members define an open space therebetween on a side thereof remote from said stop rail, and, when said stop rail is located in said retracted position, a range of motion of at least one of a damper mechanism of said piano and said hammer shanks extends into one of said open spaces between adjacent pairs of said arm members such that motion of said at least one of said damper mechanism and said hammer shanks is unhindered;

said internal structural member includes action brackets, said arm members are pivotally secured to said action brackets and extend generally upwardly therefrom and support said stop rail at a location above said damper mechanism, and only a portion of the range of motion of said damper mechanism extends into one of said open spaces; and said arm members are pivotally secured to said action brackets via supporting members extending from said action brackets generally toward said strings, and said arm members are pivotally secured, along said common axis of rotation, to ends of said supporting members closest to said strings.

13. An apparatus according to claim 12, wherein an actuating lever forms an extension of least one of said arm members and extends radially from said axis of rotation, in a direction substantially diametrically opposed to said at least one arm member;

a biasing member applies a biasing force to said actuating lever, at a location space from said rotational axis, to bias said stop rail into said retracted position; and an operating wire with a first end thereof connected to said actuating lever at a location space from said rotational axis and a second end of said wire is connected to an operating device for pulling said actuating lever, via said wire, and applying a force to said actuating lever in opposition to said biasing force for moving said stop rail from said retracted position into said stop position.

14. An apparatus according to claim 13, wherein said biasing member is a spring and said operating device is one of a hand operated lever and a foot pedal.

15. An apparatus according to claim 12, further comprising a contact cushion attached to a side of said stop rail, facing said hammer shanks, and extending substantially along the length of said stop rail, and said contact cushion has a contact surface for contacting said hammer shanks.

16. A silencing apparatus for a piano comprising:

a stop rail, when in a stop position, for contacting hammer shanks of said piano and halting motion of said shanks, in response to depression of corresponding keys of said piano, before hammers on said shanks strike strings of said piano;

a plurality of arm members being spaced axially along said stop rail and extending substantially perpendicularly therefrom, ends of said arm members, remote from said stop rail, being pivotally secured to an internal structural member of said piano along a common axis of rotation such that said arm members and said stop rail are pivotable about said axis of rotation from said stop position to a retracted position, remote from said stop position, for permitting said hammers to strike said strings;

wherein each adjacent pair of said arm members define an open space therebetween on a side thereof remote from said stop rail, and, when said stop rail is located in said retracted position, a range of motion of at least one of a damper mechanism of said piano and said hammer shanks extends into one of said open spaces between adjacent pairs of said arm members such that motion of said at least one of said damper mechanism and said hammer shanks is unhindered;

said internal structural member includes action brackets, and said arm members are secured to said action brackets and extend generally upwardly therefrom and support said stop rail at a location above said damper mechanism, and a portion of the range of motion of both said damper mechanism and said hammer shanks extend into one of said open spaces;

a biasing member applies a biasing force to one of said arm members, at a location spaced from said rotational axis, to bias said stop rail into said retracted position; and an operating wire with a first end thereof connected to said one arm member at a location spaced from said rotational axis and a second end of said wire is connected to an operating device for pulling said actuating bar, via said wire, and applying a force to said one arm member in opposition to said biasing force for moving said stop rail from said retracted position into said stop position.

17. An apparatus according to claim 16, wherein said biasing member is a spring and said operating device is one of a hand operated lever and a foot pedal.

18. An apparatus according to claim 16, further comprising a contact cushion attached to a side of said stop rail, facing said hammer shanks, and extends substantially along the length of said stop rail, and said contact cushion has a contact surface for contacting said hammer shanks.

* * * * *